US005361444A

United States Patent [19]

Theilemann

[11] Patent Number: 5,361,444

[45] Date of Patent: Nov. 8, 1994

[54] FILM CLEANING APPARATUS

[75] Inventor: Horst A. Theilemann, Munich, Germany

[73] Assignee: Retheto Filmtechnik Theilemann & Co., Munich, Germany

[21] Appl. No.: 226,063

[22] Filed: Apr. 11, 1994

[51] Int. Cl.[5] ..... G03D 15/00

[52] U.S. Cl. ..... 15/100; 15/256.5; 352/130

[58] Field of Search ..... 15/100, 256.5, 102; 352/130

[56] References Cited

U.S. PATENT DOCUMENTS 1,334,655 3/1920 Handschiegl .
1,927,284 9/1933 Howell .

FOREIGN PATENT DOCUMENTS 0302956 2/1989 European Pat. Off. ..... 15/100
685182 7/1930 France ..... 352/130
3623452 1/1988 Germany ..... 15/100

*Primary Examiner*—Edward L. Roberts
*Attorney, Agent, or Firm*—Klaus J. Bach

[57] ABSTRACT

In an apparatus for cleaning a soiled film in which the soiled film is passed upwardly through a wet cleaning station wherein a liquid cleaning agent is applied to the soiled film by means of wick plates which are pressed against the film from opposite sides and which extend downwardly into a liquid cleaning agent storage chamber from which they draw cleaning agent for wetting the film, the capillary flow of liquid cleaning agent to the film is finely adjustable by pressure panels engaging the wick plates with the upper edges of the storage chamber so as to provide for a wick plate low cross-section restriction adjacent the upper edges of the storage chamber which is finely adjustable or accurately controlling the cleaning agent supply to the soiled film.

3 Claims, 2 Drawing Sheets

FILM CLEANING APPARATUS

BACKGROUND OF THE INVENTION

The invention relates to an apparatus for cleaning soiled films which includes a transport mechanism for the film and a wet cleaning station with a storage chamber for containing liquid cleaning agent for wetting spaced wick plates between which the film passes while being wetted at both sides by the cleaning agent which is drawn into the wick plates from the storage chamber, the wick plates engaging the sides of the film with an adjustable force by means or pressure plates via an intermediate U-shaped band of cloth material.

Such a film cleaning apparatus is disclosed in DE-PS3623452. It facilitates film cleaning while consuming relatively small amounts or cleaning agents because the wick plates extend into the cleaning agent in the storage chamber and transfer the cleaning agent onto the film surface only on the basis or the capillary action of the fleece or felt of which the wick plates consist.

However, during use of this film cleaning apparatus, it became apparent that it is difficult to control the amount of cleaning liquid supplied to the film in such a manner that the film surface is wetted evenly to a minimal degree over an extended period of operation. For supplying the cleaning agent to the film, on one hand, wick plates are required which have good capillary action for transporting the cleaning agent but which, on the other hand, do not carry too much cleaning agent so that the cleaning agent dries off rapidly and evenly from the film surface upon leaving the cleaning station and before coming into contact with the redirecting guide roller. It has been tried so far to control the amount of cleaning fluid admitted to the cleaning area by testing the capillary action of the wick plates and selecting materials which supply the appropriate amount of cleaning agents to the film surface.

It is therefore the object of the present invention to provide a film cleaning apparatus which permits the use of wick plates with very high capillary action, that is, with the capability to transport a large amount of cleaning agent but which, at the same time, offers the possibility to adjust the amount of cleaning agent admitted to the surface of the film in such a way that the cleaning agent supplied by the wick plates to the film per time unit is reduced to the absolutely necessary amount and this amount can be maintained at a constant level.

SUMMARY OF THE INVENTION

In an apparatus for cleaning a soiled film in which the soiled film is passed upwardly through a wet cleaning station wherein a liquid cleaning agent is applied to the soiled film by means of wick plates which are pressed against the film from opposite sides and which extend downwardly into a liquid cleaning agent storage chamber from which they draw cleaning agent for wetting the film, the capillary flow of liquid cleaning agent to the film is finely adjustable by pressure panels engaging the wick plates with the upper edges of the storage chamber so as to provide for a wick plate flow cross-section restriction adjacent the upper edges of the storage chamber which is finely adjustable for accurately controlling the cleaning agent supply to the soiled film.

With this apparatus it is possible to utilize wick plates with high capillary action wherein however the amount of cleaning agent supplied to the film surfaces can be adjusted by squeezing the wick plates whereby the cross-section of the wick plate at the upper end of the storage chamber can be finely adjusted. Since the cleaning agents used have a high degree of purity, no detrimental influence to the capillary action in the area of reduced cross-section is to be expected even over long periods of time and furthermore, by limiting the amount of cleaning agent, the drying time after passage of the film through the cleaning station can be reduced to a minimum, that is, a substantially shorter vaporizing distance is required than is needed for any other of the known apparatus with special arrangements or drying and removing the vapors by suction, even with high film moving speeds. The supply of cleaning agent is easily adjustable by adjusting the pressure applied by the pressure plates since a uniform drying process can be easily recognized optically by the drying streaks forming on the emulsion side of the film.

With a further feature according to the invention wherein the lower edge of the pressure plates is fixed at the bottom of the storage chamber in such a way that the wick plates are not compressed in the bottom area, a particularly fine adjustability is possible since the cleaning agent transport by means of capillary action is inhibited only in the short area of reduced cross-section of the wick plates so that the cleaning agent supply ahead of the reduced cross-section is sufficiently high to provide for a uniform distribution and flow of cleaning agent through the reduced cross-section area.

The pressure plates may also extend from the upper edge of the storage chamber upwardly and they may have a projection or a web at their upper end which narrows the cross-section of the wick plates locally adjacent the top edge of the storage chamber.

This feature narrows down the cross-section of the wick plates only over a short length which is particularly advantageous for controlling the amount of cleaning agent supplied by the wick plates to the film per time unit.

U.S. Pat. No. 1,334,655 discloses a film cleaning apparatus in which a wick structure also extends into a storage chamber with a liquid cleaning agent wherein however the wick structure extends over the edge of the storage chamber downwardly to the surface of the film and is disposed thereon in sliding contact therewith. In this arrangement, the wick structure works like a siphon pipette. The wick structure is guided in the area leading downwardly in a clamping structure by which the wick structure can be compressed by means of a pressure plate for controlling the amount of liquid passing therethrough. The pressure plate reduces the cross-section along the wick structure over a large area which makes fine adjustment with regard to the amount of cleaning liquid supplied by the wick structure per time unit impossible.

The invention with its particular features and advantages will become more readily apparent from the following description thereof.

DESCRIPTION OF PREFERRED EMBODIMENTS

Figure 1:
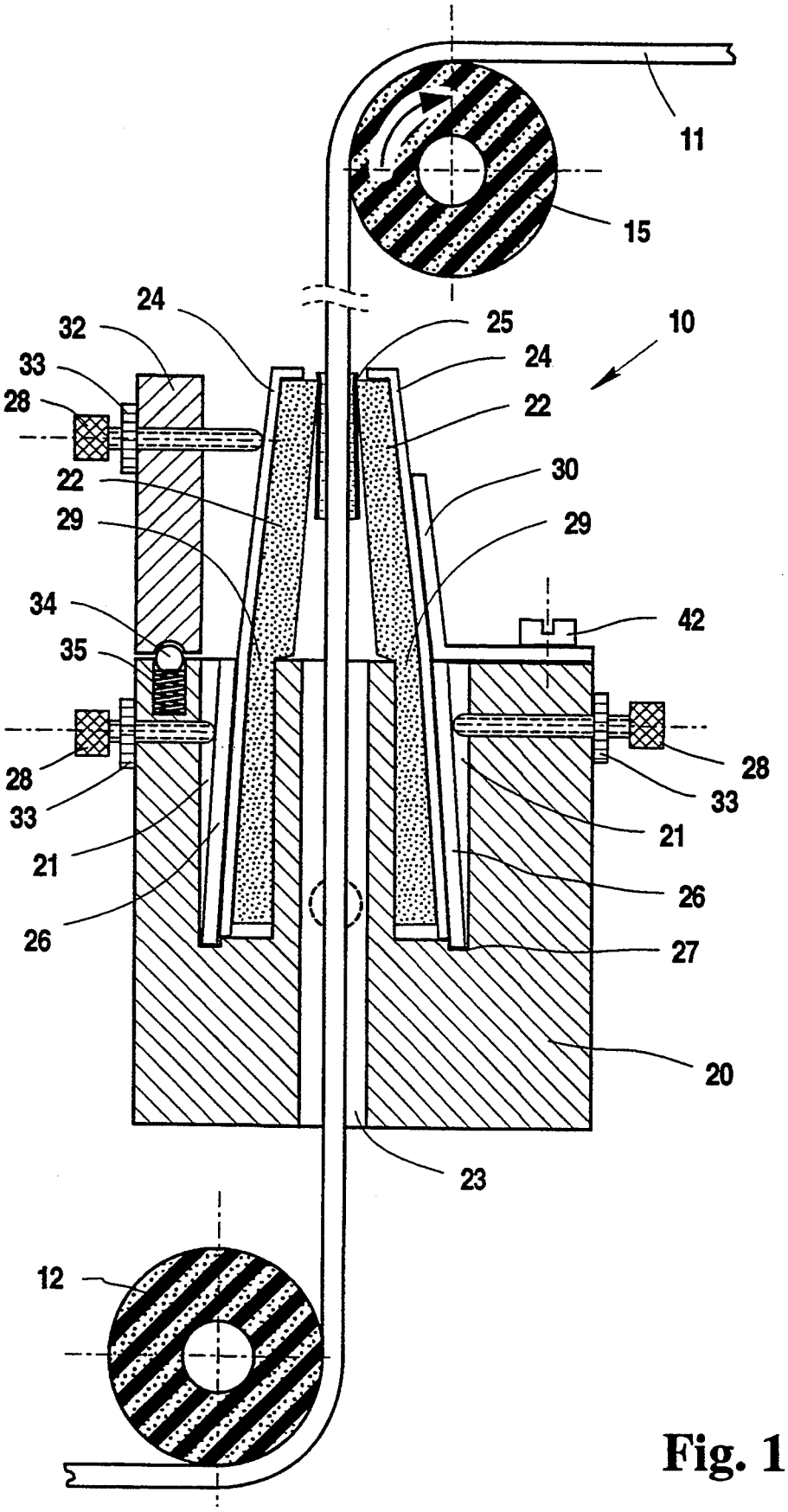
FIG. 1 is a side cross-sectional view of the film cleaning apparatus according to the invention.

FIG. 1 shows schematically a cleaning station 10 for cleaning a film 11 wherein the film 11 is guided into the cleaning station by means of a guide roller 12 and, after leaving the cleaning station, is guided away by way of a guide roller 15. The cleaning station 10 includes a container 20 having a storage chamber 21 consisting essentially of a U-shared cavity which is formed in the container 20 and which is open at the upper end of the container. A liquid cleaning agent is supplied to the storage chamber 21 from a storage container by way of supply ducts which are not shown in the drawings and care is taken that the storage chamber is always filled with cleaning liquid to about half of its height.

As cleaning liquids the usual rapidly vaporizing agents used for this purpose are employed.

The container 20 has a slot 23 which extends upwardly between the legs of the U-shared storage chamber 21 and through which the film 11 is guided. Wick plates 22 are disposed in the legs of the storage chamber 21 which consist of a material with good capillary properties, preferably of felt or fleece. These wick plates extend upwardly from the storage chamber and are covered on their outer surfaces by compression panels 24 which are preferably of an elastic material and, in the area of the upper edge of the container 20, slightly bent-over toward the film 11. The wick plates 22 do not directly abut the film 11 but engage a U-shaped cloth material strip 25 which consists preferably of velvet and between which the film 11 passes. This strip of cloth material picks up soil loosened from the film.

Also disposed in the storage chamber 21 are pressure panels 26 which are disposed on the outer surface of the compression plates 24. The pressure panels are retained at their bottom and in grooves 27 formed in the bottom of the storage chamber and can be pressed against the compression plates 24 and consequently against the wick plates 22 by means of compression screws 28. The compression screws 28 are arranged in the upper area of the storage container 20 so that the pressure forces applied by their tightening to the pressure panels 26 is transmitted to the wick plates 22 in such a way that the wick plates are engaged especially at one end such that particularly at the upper edge of the storage chamber 21 a reduced cross-section 29 is formed by which the amount of cleaning agent can be controlled which, on the basis of the capillary action, can flow through the wick plates up to the cleaning gap, that is, to the cloth material strip 25. Since the lower edge of the pressure panels 26 are retained in the grooves 27 and only the upper parts of the pressure panels 26 can be moved toward the wick plates, the portion of the wick plates which extends into the cleaning liquid retains full capillary action so that sufficient cleaning liquid is supplied to the cloth material strips.

On the right side of the container 20 as shown in FIG. 1, the compression plate 24 of resilient material is held in abutment with the film 11 by means of a backup angle piece 30 which has an upwardly extending leg which insures that the upper end of the wick plate extends up into the cleaning slot and, in this position, is subjected to an engagement force as applied to the opposite side thereof.

This engagement force is applied by a support plate structure 32 into which a compression screw 28 is screwed by which the engagement force is adjustable. With the engagement force adjustability, a selected pressure can be applied to the film at the upper edges of the wick plates 22 through the cloth material strips which pressure however should not be excessive if a uniform wetting of the film is to be achieved. For this purpose, the adjustable compression screw 28 and also the two other compression screws 28 on the container 20 are provided with lock nuts 33 fop fixing a particular position. The support plate structure 32 is pivotable about a vertical rear axis which is not visible in the figures but it is held in the position shown by a locking ball 34 biased against the underside of the support plate structure 32 by means of a spring 35. If the pressure applied to the wick plate 22 by the compression plate 24 when adjusted by the compression screw 28 becomes excessive, the support plate structure 32 disengages from the locking ball 34 and is pivoted outwardly so that not more than a maximum pressure can be applied to the film. If this pressure is exceeded, the support plate structure is released so that the pressure with which the wick plates are biased toward one another and by which they define a predetermined length of the cleaning gap is not exceeded.

Figure 2:
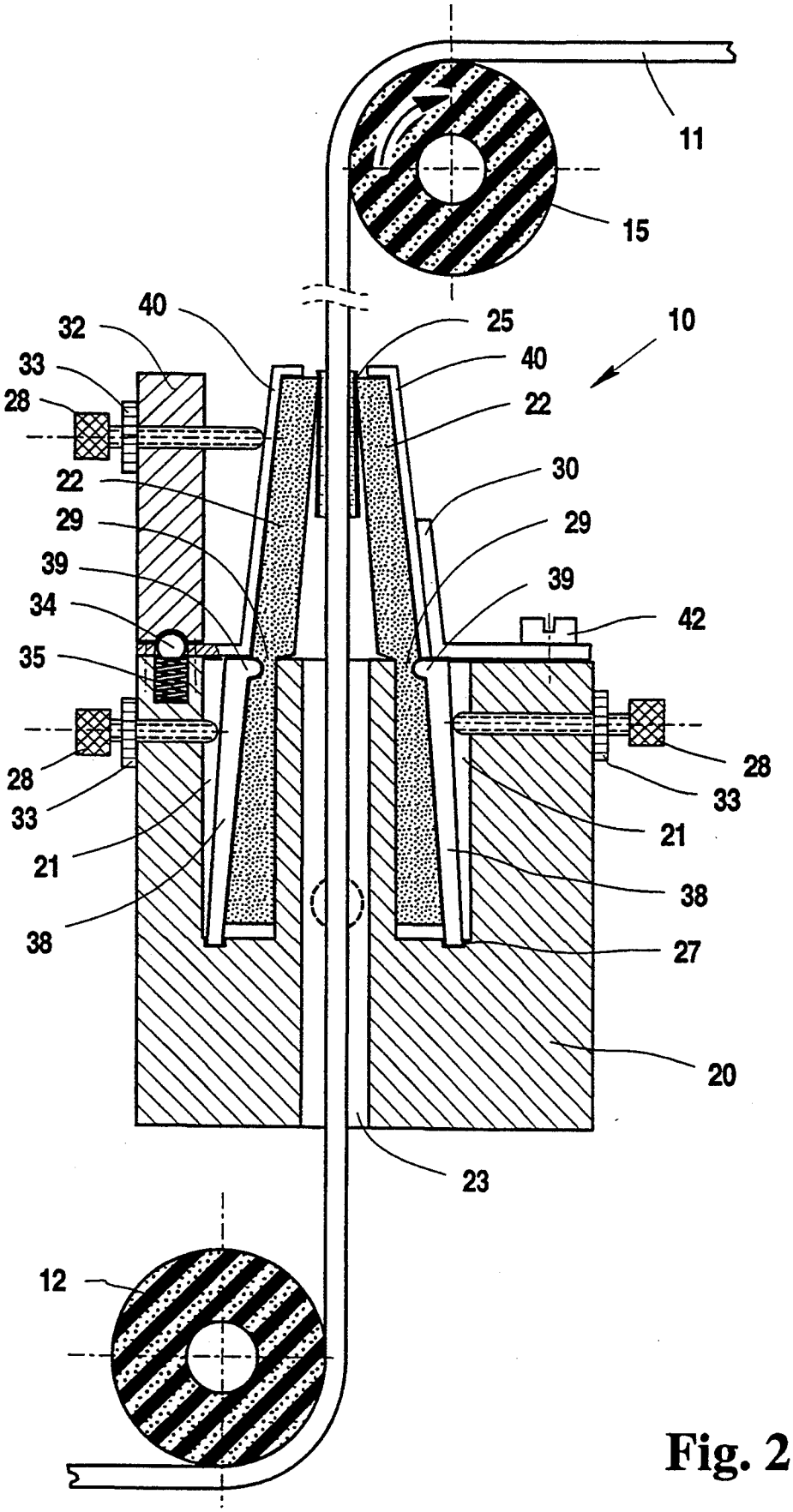
FIG. 2 is the same view of another embodiment of the invention.

FIG. 2 shows another embodiment of the invention which differs from the embodiment according to FIG. 1 in that the pressure panels 38 are in direct engagement with the wick plates 22 and are provided in the area of the reduced flow cross-section of the wick plates with bulges or projecting webs 39 by which a limited local cross-section restriction is formed which is better adjustable for controlling the cleaning liquid flow drawn by the capillary action upwardly into the cleaning gap. In this arrangement the pressure plates 40 do not extend into the storage chamber but only to the top of the container 20. The right side pressure plate 40—as shown in FIG. 2—is firmly connected to the angle piece 30. The angle piece 30 is mounted to the top side of the container 20 by a screw 42 and it has a longitudinal slot which is not visible in the figure but by which it can be moved back and forth for mounting it in a position in which it provides optimal pressure to the wick plate 22 in the area of the cleaning gap. Also, in this arrangement the pressure plates 40 preferably consist of a resilient material so that they have a certain elasticity in the area of the cleaning gap. The pressure plate 40 arranged at the left side of the film as shown in the figure has its angled foot portion firmly mounted to the container underneath the support plate structure 32. Because of its elasticity it can be prestressed toward the film by means of the pressure screw 28 as mentioned earlier, but also then, the maximum prestress force is limited by the retaining capability of the locking ball 34, that is, the force required to dislodge the ball from its engagement with the underside of the support plate structure 32.

Operation of the cleaning station corresponds essentially to that as disclosed, or example, in DE-PS 3623452 as far as the wetting of the film by the wick plates and the cloth material strip and the retaining of the dislodged particles by this cloth material strip are concerned.

The arrangement according to the invention however makes it possible to control very accurately the capillary action in the wick plates by fine adjustment of the wick cross-section restriction, so that only so much cleaning liquid can be permitted to reach the cleaning gap as is required for the dissolution of any soil and for the removal of the soil by the cloth material strip. By cooperation of the cross-section 29, that is, the wick plates 22 and the adjustment of the engagement pressure of the wick plates via the textile material strip in the area of the cleaning gap, the amount and the distribution of the cleaning fluid applied to the film can be optimally adjusted for long-term constant operation whereby the length of time required for the evaporation of the cleaning fluid from the film after leaving the cleaning gap is substantially reduced as compared to prior art arrangements because of the uniform application of the cleaning fluid onto the film.

What is claimed is:

1. An apparatus or cleaning soiled films comprising: a transport mechanism for the film, a wet cleaning station including a storage chamber for containing liquid cleaning agent, a pair of wick plates of capillary material received in said storage chamber so as to be wetted by the liquid cleaning agent disposed therein and extending therefrom upwardly in spaced relationship for receiving therebetween said films to be cleaned, pressure plates extending upwardly from said storage chamber adjacent said wick plates and engaging said wick plates and pressing them with an adjustable force toward one another and into contact with the soiled film for wetting the film passing therebetween via a U-shaped cloth strip disposed between said wick plates and said film, a pressure panel disposed in said storage chamber adjacent each wick plate, a compression structure disposed adjacent each pressure panel and extending through the storage chamber wall for forcing said pressure panel into engagement with said wick plate with an adjustable force, said storage chamber having upper edges adjacent said wick plates and said pressure panels engaging said wick plates with said upper storage chamber edges so as to provide a capillary flow passage restriction in said wick plates adjacent said upper storage chamber edges with a restricted cross-section which is adjustable by said compression structure.

2. An apparatus according to claim 1, wherein said pressure panels have lower edges retained at the bottom of said storage chamber in such a way that said wick plates are not compressed at the bottom end of said storage chamber.

3. An apparatus according to claim 1, wherein each of said pressure panels has, at its upper end adjacent the upper edges of said storage chamber, a web projecting toward said wick plate and engaging said wick plate for locally restricting the flow cross-section of said wick plate.

* * * * *